US007021486B1

(12) United States Patent
Hurlbut

(10) Patent No.: US 7,021,486 B1
(45) Date of Patent: Apr. 4, 2006

(54) DRINKING FLASK

(75) Inventor: Gary A. Hurlbut, Seattle, WA (US)

(73) Assignee: Pacific Market, Inc, Seattle, WA (US)

( * ) Notice: Subject to any disclaimer, the term of this patent is extended or adjusted under 35 U.S.C. 154(b) by 513 days.

(21) Appl. No.: 10/145,549

(22) Filed: May 14, 2002

(51) Int. Cl.
*B65D 51/18* (2006.01)
*B65D 55/16* (2006.01)
*B65D 83/00* (2006.01)
*B65D 90/02* (2006.01)

(52) U.S. Cl. ..... 220/379; 215/230; 215/313; 215/382; 215/385; 215/398; 220/254.9; 220/256.1; 220/259.5; 220/297; 220/379; 220/714; 220/771; 222/520; 222/549

(58) Field of Classification Search ..... 215/313, 215/385, 398, 6, 387, 382, 383, 384, 230; 220/714, 297, 259.5, 771, 379, 290, 501, 220/259.4, 259.3, 254.8, 254.9, 256.1; 222/520, 222/549
See application file for complete search history.

(56) References Cited

U.S. PATENT DOCUMENTS

D145,212 S * 7/1946 Havens ..... D9/528
4,575,074 A * 3/1986 Damratoski ..... 482/93
4,634,028 A * 1/1987 de Larosiere ..... 222/464.2
4,691,828 A * 9/1987 Slusarczyk et al. ..... 206/509
4,867,325 A * 9/1989 Dransfield ..... 215/11.2
5,207,338 A * 5/1993 Sandhu ..... 215/11.1
5,211,299 A * 5/1993 Manfredonia ..... 215/11.1
5,215,203 A * 6/1993 Malcolm ..... 215/384
5,244,106 A * 9/1993 Takacs ..... 215/373
5,368,186 A 11/1994 Yeh
5,372,275 A 12/1994 Yeh
5,477,979 A 12/1995 Goessling et al.
5,690,242 A * 11/1997 Campbell, Jr. ..... 215/273
5,810,185 A * 9/1998 Groesbeck ..... 215/387
5,862,941 A * 1/1999 Jones ..... 220/772
6,059,132 A * 5/2000 Benjamin ..... 215/206
6,202,877 B1 3/2001 La Torre et al.

* cited by examiner

*Primary Examiner*—Jes F. Pascua
*Assistant Examiner*—Niki M. Eloshway
(74) *Attorney, Agent, or Firm*—Black Lowe Graham PLLC

(57) ABSTRACT

A drinking flask cap is a convenient, three-position, push-pull lid. The top of the lid forms a drinking basis, and the drinking basin can be sealed with a hygienic cap. The cap can be removed and placed on the bottom of the flask for convenient storage and provides a stable base for the flask. A bottle portion of the flask is preferably made from a molded plastic material and can be provided with a finger hold such that the flask can be drunk from in a manner similar to a coffee cup.

20 Claims, 4 Drawing Sheets

FIG. 3
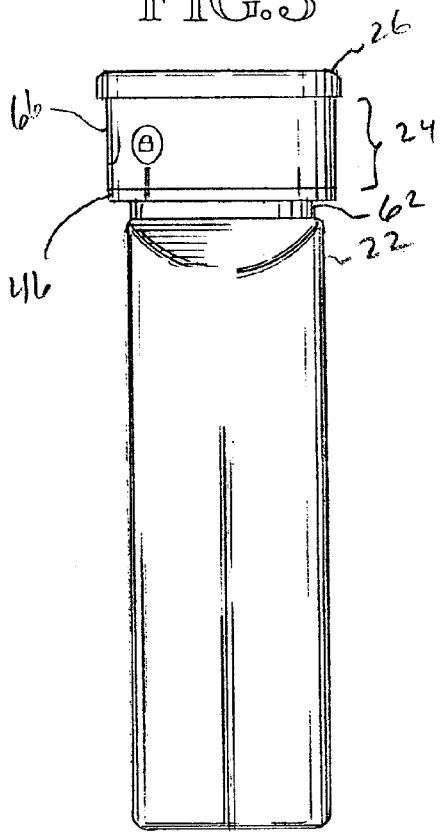
FIG. 4
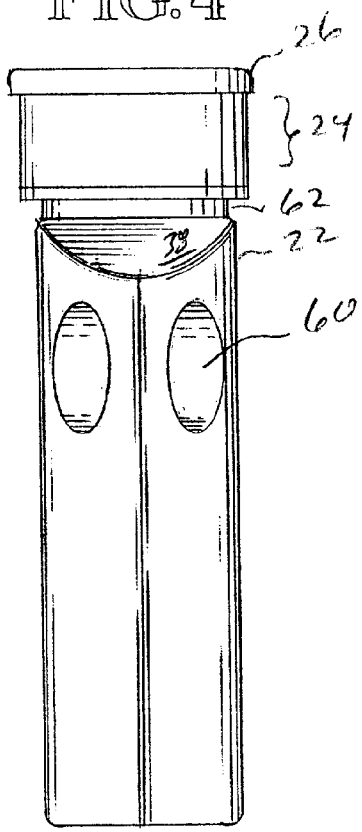
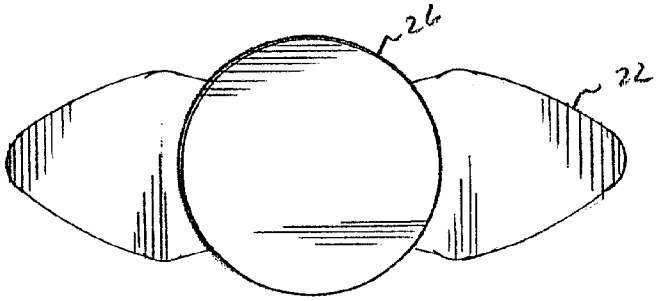
FIG. 5
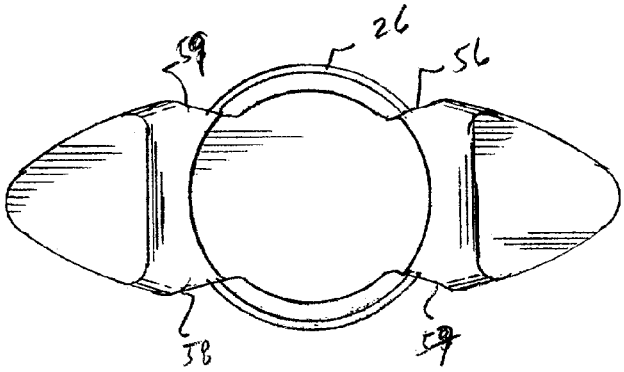
FIG. 6

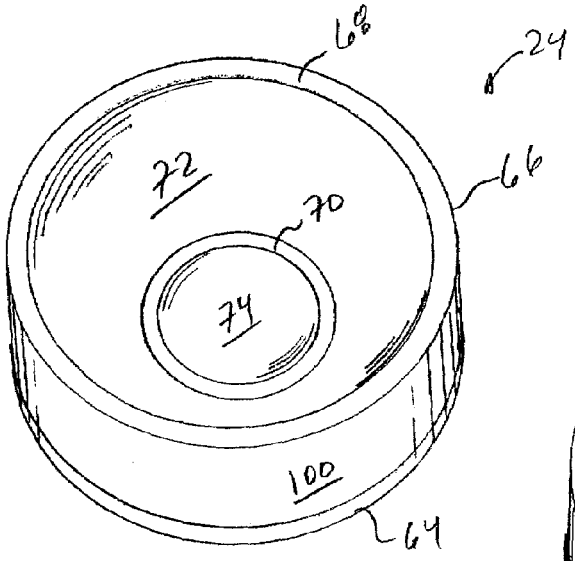
FIG. 7
FIG. 8
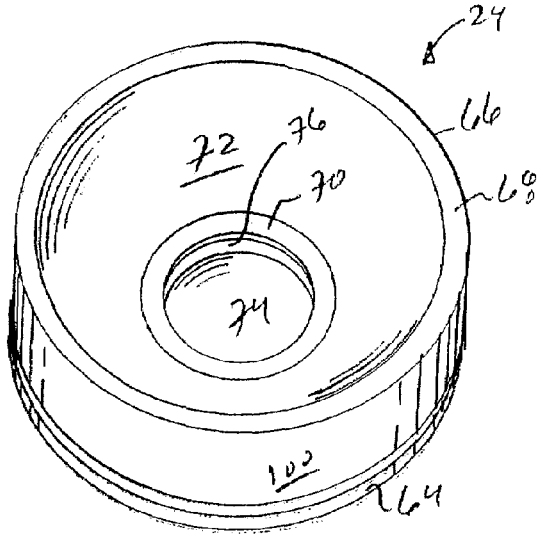
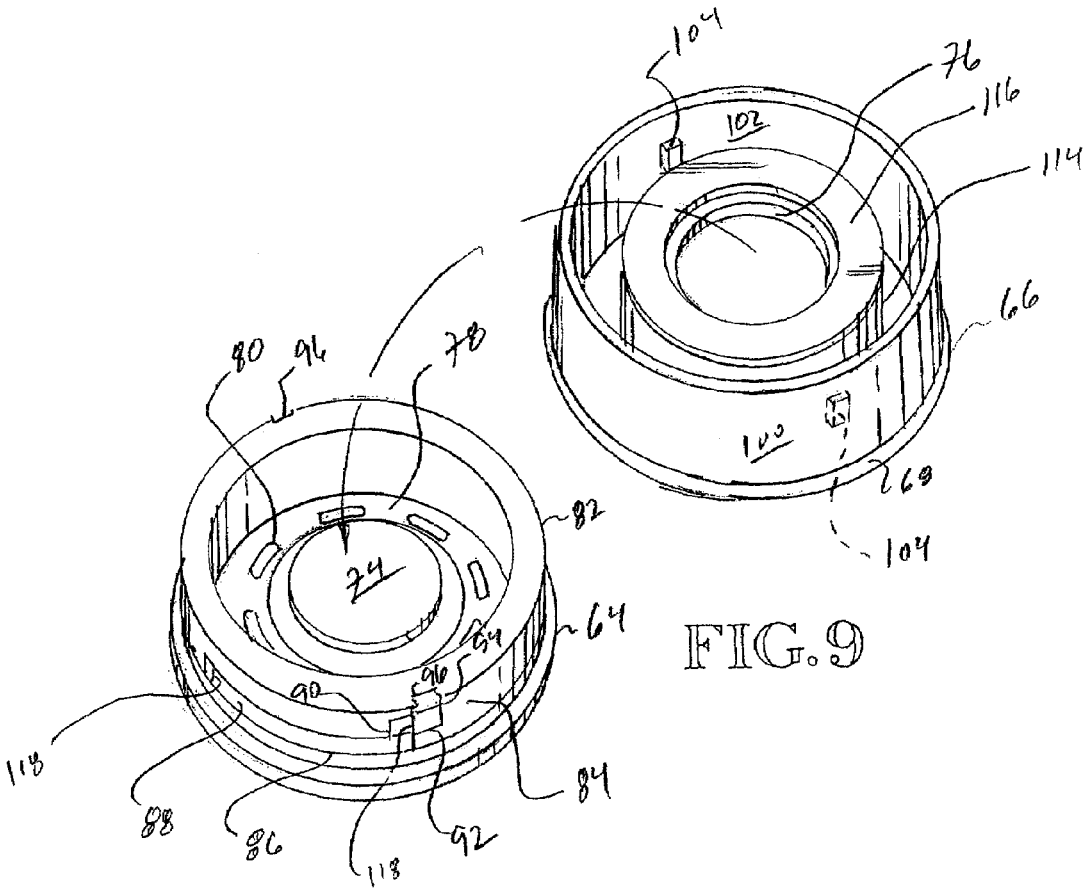
FIG. 9

DRINKING FLASK

TECHNICAL FIELD

Invention relates to sports-oriented bottles and flasks. More specifically, the invention relates to sports-oriented bottles and flasks having a substantially unbreakable body and a push-pull type lid.

BACKGROUND OF THE INVENTION

The general public has become increasingly aware that proper hydration is necessary for maintaining good health. Certain medical authorities have suggested that in order to obtain optimal health it is necessary for the average individual to drink six to eight glasses of water per day. Recreational athletes, such as cyclists, runners, and hikers, have recognized the importance of proper hydration while exercising for some time. Therefore, various styles of unbreakable water bottles have been developed, the most familiar of which is a substantially cylindrical, flexible plastic bottle having a push-pull top. The push-pull top can be actuated by grasping a transverse flange on the top with the user's teeth so as to open the bottle with one hand. The bottle itself is typically manufactured from a flexible material, such as polyethylene, so that the bottle may be squeezed by the user to provide a stream of water, either for drinking or for drenching the user's head or face to avoid overheating.

Bottles of this type have even been adapted for receipt in so-called "cages" on bicycles so that the cyclist may constantly hydrate himself or herself while riding the bicycle and without stopping simply with the use of a single hand.

Unfortunately, non-athletes and athletes not then engaged in athletic activities find such sports bottles to be limited in their effectiveness for use during routine daily tasks, such as being at the office. Specifically, the bottles are aesthetically unappealing for use in a business environment in that they cannot be sipped from in a manner similar to a coffee cup. In addition, the aforementioned sports bottles are typically cylindrical in configuration, having a diameter of approximately four inches. The typical thickness of a commuting briefcase may only be on the order of three inches, thus rendering transportation of the water bottle on a daily basis for the office environment difficult.

Thus, a need exists for a hydration flask or bottle optimized for daily use, including the ability to fit into a standard briefcase and the ability to drink from such a bottle in an appropriate manner, such as in sipping a beverage from a coffee cup or the like.

SUMMARY OF THE INVENTION

It is therefore an object of the present invention to provide for a hydration flask or bottle having a relatively thin profile and an ergonomic design suitable for drinking from in a non-casual environment, such as a business office.

It is a further object of the present invention to provide for a drinking bottle or flask which achieves the above object while providing a locking mechanism on the bottle which permits the bottle to be securely closed for traveling while in a briefcase or the like, yet which will permit the user to sip from the bottle in a manner similar to a coffee cup.

It is yet another object of the present invention to provide for a drinking bottle or flask which achieves the above objects and which also facilitates easy cleaning to maintain the same in a hygienic condition.

The invention achieves the above objects, and other objects and advantages which will become apparent from the description below, by providing a hydration bottle or drinking flask having an ergonomically shaped, substantially hollow bottle, surmounted by a removable, multi-position lid. The bottle preferably has a central, elongated columnar portion having top and bottom ends, the top end being adapted for receipt of a three-position drinking lid. The columnar portion preferably has a diameter of less than approximately three inches. To increase the volume of the bottle, the columnar portion is flanked by and in fluid communication with at least two wing-like appendages, which are substantially axially coextensive with the columnar portion. The lid is preferably removable from the bottle to permit filling the bottle with water or a sports beverage. The lid is preferably circular and forms a drinking basin, such that a user can drink from the lid in a manner similar to a coffee cup.

In the preferred embodiment of the invention, the lid has a base portion which is removably attached to the upper end of the columnar portion and an upper portion which is rotatably and axially movable with respect to the base portion. Thus, the lid is preferably provided with a mechanism for orienting the upper portion and the base portion in a first closed and locked position, a second drinking position, and a third position in which the upper portion is removable from the base portion for cleaning. The mechanism can be in the form of a bayonet-type mechanism in which the upper portion has one or more inwardly directed projections, or dogs, which mate with corresponding tracks in the base portion. The tracks can be provided with a first circumferential groove having at its beginning end the closed and locked position. The end of the first circumferential track can terminate in a vertically directed second track, wherein the upper portion is rotated and then lifted, with respect to the base portion, into a second open position, allowing fluid to flow from the inside of the bottle, through the base portion, and into the drinking basin defined by the upper portion. The second track can terminate in a short, circumferential third track, which terminates in a vertical fourth track. By rotating the upper portion with respect to the base portion, through the circumferential third track and vertically through the fourth track, the upper portion can be removed from the base portion so the two portions can be cleaned in a sink or dishwasher. In the preferred embodiment, various graphics may be provided in the upper portion to indicate the various positions of the lid.

The wing portions on the bottle can meet the columnar portion at inwardly directed sidewalls to provide external finger grooves for the bottle. In addition, one of the lateral-extending wing portions can define in an upper corner thereof a finger hole such that an upper shoulder portion of that wing forms a thumb rest. The aperture defines an index finger hole or handle, and a groove in a junction between that wing portion and the columnar portion forms a resting place for the remaining three fingers of a user's hand. In this way, the flask may be grasped in a manner similar to a coffee cup.

Finally, the upper portion of the lid can be provided with a removable hygiene cap which engages a rim of the upper portion in a friction fit. The bottom end of the columnar portion can be provided with similar structure so that the hygiene cap can be stored thereon. Preferably, the wing portions extend downwardly, slightly below the columnar portion, so that when the hygiene cap is accepted thereon, the entire flask forms a flat bottom surface for supporting the flask with respect to a flat surface, such as a table or the like.

BRIEF DESCRIPTION OF THE DRAWINGS

FIG. 3 is a right side elevational view of the flask.

FIG. 4 is a left side elevational view of the flask.

FIG. 5 is a top plan view of the flask.

FIG. 6 is a bottom plan view of the flask.

FIG. 7 is a top left isometric view of the lid of the flask in a closed position, with a hygiene being removed therefrom.

FIG. 8 is a view, similar to FIG. 7, with the lid being shown in an open position.

FIG. 9 is an exploded, isometric view of the lid illustrating the top side of a bottom portion of the lid and the bottom side of an upper portion of the lid.

DETAILED DESCRIPTION OF THE PREFERRED EMBODIMENTS

Figure 1:
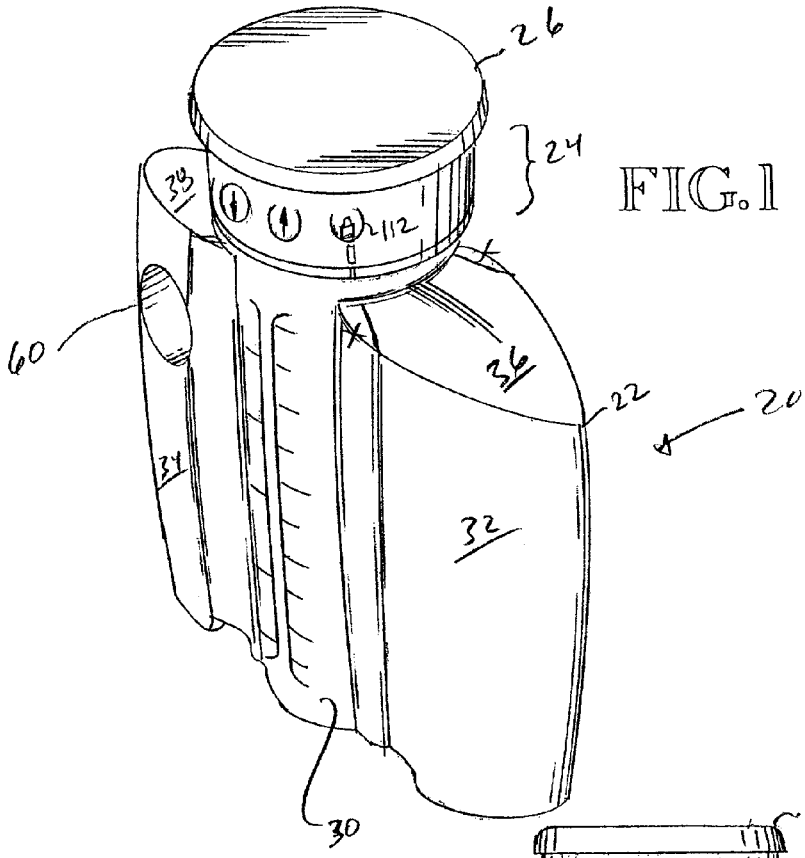
FIG. 1 is a top, right isometric view of a drinking flask in accordance with the general principles of the invention.
Figure 2:
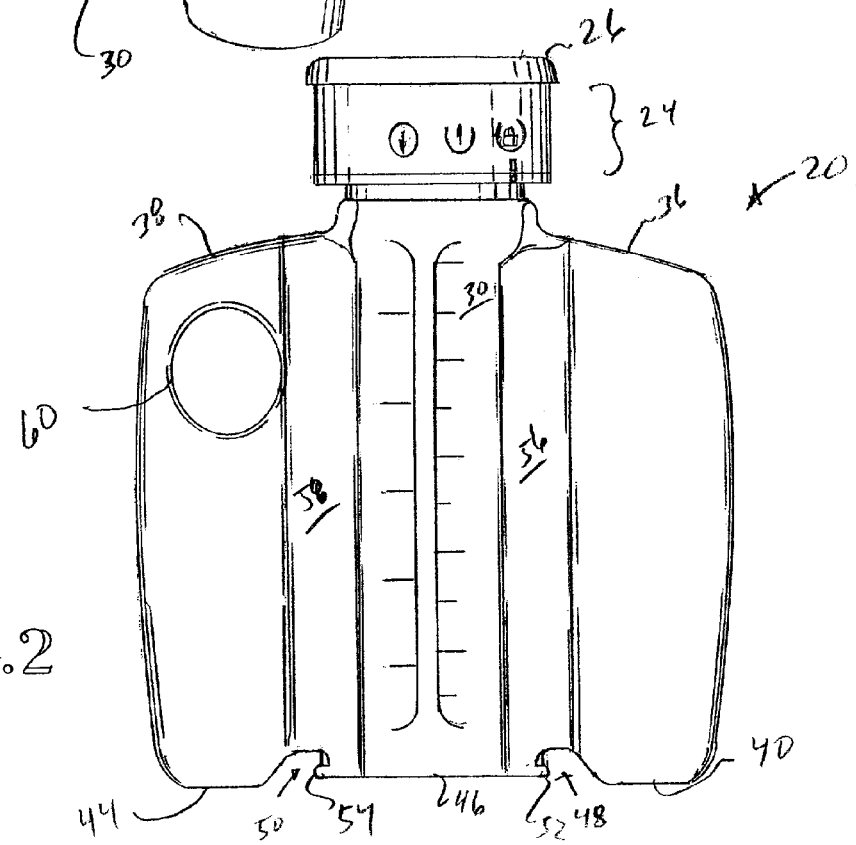
FIG. 2 is front elevational view of the flask shown in FIG. 1.

A hydration bottle or drinking flask, in accordance with the principles of the invention, is generally indicated at reference numeral 20 in FIGS. 1 through 6 of the attached drawings, where reference numerals in the drawings refer to like-numbered elements below.

The flask 20 has a substantially flask-shaped, hollow bottle 22 for receiving a liquid, such as water or a sports beverage, a two-piece lid generally indicated at reference numeral 24, and a removable, friction-fit hygiene cap 26. The bottle 22 is preferably manufactured from a transparent, rigid material, such as an injection-molded acrylic thermoplastic material. The bottle is provided with a central columnar portion 30 having a diameter of approximately two and one-half inches. In order to provided the bottle with an interior volume of approximately one-half liter (20 fluid ounces) and an ergonomic shape, the bottle is provided with two laterally extending wing portions 32, 34 which are in fluid communication with the columnar portion 30. Each wing portion has upper shoulder sections 36, 38 and flat bottoms 40, 44. The columnar portion 30 has a lower end 46 which is slightly raised with respect to flat bottoms 40, 44 by approximately the thickness of the hygiene cap 26. The bottoms 40, 44 of the wing sections and the columnar portion 30 merge at indented regions 48, 50 so as to form laterally extended ledges 52, 54 adapted to receive the hygiene cap 26 in a snap fit thereon, such that the bottoms 40, 44 and the hygiene cap 26, when mounted on the lower end 46, reside substantially in the same plane so that the flask 20 may reside on a smooth surface, such as a table top, in a drinking configuration to be further described below. The wing portions 34, 36 further have inwardly canted sidewalls 56, 57, 58, and 59, providing fingertip resting surfaces for a user's hand when grasping either side of the flask 20. One of the wings is preferably provided with a through hole in the form of a transverse bore 60, such that an index finger may pass therethrough and a thumb may rest upon the upper shoulder section 38, such that the flask may be grasped in a manner similar to a coffee cup, with the tips of the user's remaining fingers resting in a trough defined by the sidewall 59.

The columnar portion 30 is also provided with an upper end 62 forming an open mouth (not shown) in the conventional manner of a bottle. The upper end supports the two-piece lid 24 so as to permit passage of fluid from the bottle to the lid. The lid is of the push-pull type. However, the lid consists of a base portion 46 and a rotationally and axially movable upper portion 66. As best seen in FIGS. 7 and 8, the upper portion 66 has an upper, circular drinking lip 68 and a lower circular rim 70, defining therebetween a spherical or conical drinking basin 72. The base 64 has a circular, central stopper portion 74, which is adapted to close a drinking aperture 76, defined by the rim 70, when the lid is in a first, closed position shown in FIG. 7. Alternately, and as will be described in further detail below, the lid 24 can be moved to a second, open position by rotating the upper portion 66 counter-clockwise with respect to the base portion 64 and then axially moving the upper portion with respect to the base portion 64. In this manner, a user can drink from the basin 72 when the lid is in the open position shown in FIG. 8.

The lid 24 is secured to the upper end 62 of the columnar portion 30 by providing cooperative threads on the upper end 62 (not shown) and on an underside of the base portion 64 (not shown) in the conventional manner. The base portion is provided with a floor region 78 surrounding the stopper portion 74, such that the stopper portion 74 is elevated with respect thereto. The floor region defines a plurality of flow apertures 84 for drinking basin 72 to be in communication with the interior of the bottle 22 when the lid is in the open position shown in FIG. 8. In order to provide for relative rotational and axial movement of the upper portion 66 with respect to the base portion 64, the base portion is provided with a circumferential, upwardly directed cylindrical section 82 having an outer sidewall 84. The sidewall 84 preferably has two, diametrically opposed tracks 86. Tracks 86 form a means for actuating the upper portion 66 of the two-piece lid 24 from a first closed and locked position shown in FIG. 7, through an open drinking position shown in FIG. 8, and to a third position in which the upper portion can be removed from the base portion shown in FIG. 9. Each track 86 has an elongated, circumferential first groove 88 terminating in a short, vertical second groove 90, which itself terminates in a short, circumferential third groove 92. Thus, the short, circumferential third groove 92 is disposed above the elongated, circumferential first groove approximately by the height of the grooves, with the short vertical second groove 90 forming a pathway therebetween. The short, circumferential third groove itself terminates in a short, vertical fourth groove 94, terminating in an open end 96. The first groove preferably subtends an angle of approximately 40 degrees, while the second groove subtends an angle of approximately 5–10 degrees.

Figure 10:
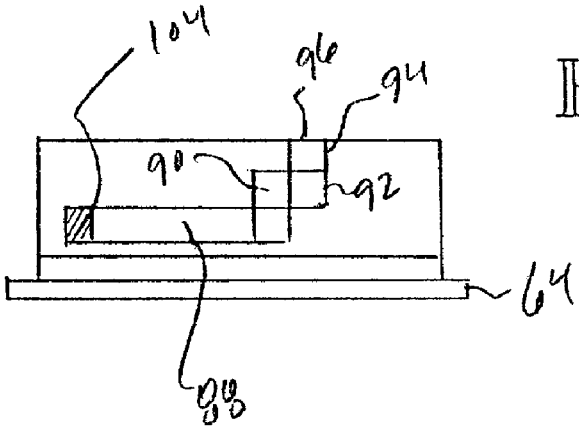
FIG. 10 is a schematic representation of the lid showing the base portion thereof and a dog ear of the upper portion in a closed and locked position.
Figure 11:
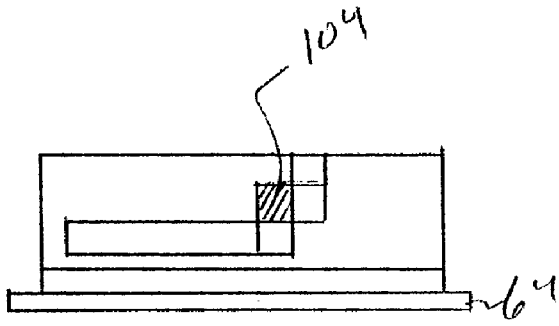
FIG. 11 is a schematic representation, similar to FIG. 10, showing the base portion and a dog ear of the upper portion of the lid in a second drinking position.
Figure 12:
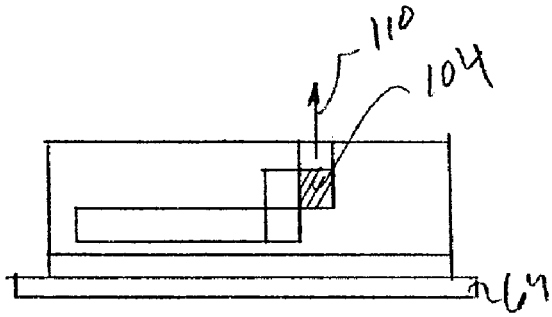
FIG. 12 is a schematic representation, similar to FIGS. 10 and 11, showing the base portion and a dog ear of the upper portion of the lid and a third position in which the upper portion of the lid is vertically removable from the lower portion of the lid.

The upper portion 66 has a downwardly depending sidewall 100, which overlaps the outer sidewall 84 of the base portion 64. An inside 102 of the sidewall 100 includes diametrically opposed, radially directed projections 104, which are sized and shaped to be received in the tracks 86. In this manner, and as best seen in FIGS. 10 through 12, the upper portion 66 is constrained to rotate in a counter-clockwise fashion, from the closed and locked position shown in FIG. 7 and schematically illustrated in FIG. 10, until the projection 104 reaches the end of the first groove 88 and can be pulled vertically into the open position shown in FIG. 8, with the projections 104 residing at the end of the second vertical grooves as shown in FIG. 11. In order to remove the upper portion from the base portion, such as for cleaning, the upper portion 66 then may be further rotated in the counter-clockwise direction, such that the projection 104 assumes the position shown in FIG. 12, and the upper portion may be vertically removed from the base portion such that the projection 104 travels in the direction of arrow 110 in FIG. 12. The upper portion 66 of the two-piece lid 24 is preferably provided with graphical symbols 112 to indicate the closed and locked position, the drinking position, and the removable position.

In order to provide a leakproof seal when the lid 24 is in the closed and locked position, the upper portion 66 of the two-piece lid 24 is preferably provided with a central, downwardly directed annulus 114 having a toroidal seal 116 on a lower surface thereof for blocking the flow apertures 80 whenever the projections 104 are received in the first groove 88. Detents in the form of short, raised bars 118 are preferably provided adjacent to a beginning end of the first groove 88, and between an end of the first groove 88 and a transition between the end of the second groove 90 and the third groove 92. This manner of making detents is believed to be well known to those of ordinary skill in the thermoplastic injection molding art and thus will not be described further.

The above-described drinking flask 20 provides a convenient means for office workers and the like to maintain optimal hydration in a semi-formal environment, such as a business office. The flask is easily transportable in a briefcase or sports bag without fear of leakage due to the sealing arrangement of two-piece lid 24, yet is extremely convenient due to the push-pull operation of the lid. The hygienic cap 26 prevents the drinking basin 72 from becoming soiled, yet can be conveniently stored on the lower end 46 of the columnar portion 30 so as to provide a flat, stable base for the entire flask. Other embodiments and minor variation of the above-described preferred embodiment are contemplated and will become apparent to those of ordinary skill in the relevant art upon reviewing this disclosure. Therefore, the invention is not to be limited by the above disclosure, but is to be determined in the scope of the claims which follow.

I claim:

1. A drinking flask, comprising:

a cap;

a substantially hollow bottle having a central, elongated columnar portion having upper and lower ends, the lower end being adapted for removable receipt of the cap, the columnar portion being in fluid communication with diametrically opposed, elongated, laterally extending wing portions at junction regions there between; and, a drinking lid removably attached to the upper end of the columnar portion, wherein the lid defines a drinking basin sized to accept a user's lips and to removably accept the cap in a friction fit, such that the lower end with the cap thereon and bottoms of the wing portions are substantially aligned in a plane so that the flask can rest on a surface in a drinking configuration.

2. The drinking flask of claim 1, wherein the drinking lid has a base portion and an upper portion including actuating means for rotatably and axially moving the upper portion with respect to the base portion between a first locked position, a second drinking position and a third removed position.

3. The drinking flask of claim 2, wherein the actuating means includes a guide track on an outer perimeter of the base portion and a radially inwardly directed projection on the upper portion for receipt in the guide track, wherein the guide track has an elongated circumferential first groove terminating in a short vertical second groove, the second groove terminating in a short, circumferential third groove, and the third groove terminating in a short vertical fourth groove having an open end.

4. The drinking flask of claim 3, including detents between the fist and second grooves and between the third and fourth grooves.

5. The drinking flask of claim 3, wherein the first circumferential groove subtends an angle of approximately forty degrees and wherein the third circumferential groove subtends an angle of approximately ten degrees.

6. The drinking flask of claim 3, including a detent in the first groove adjacent to an end of the first groove away from the second groove corresponding to a closed and locked position of the lid.

7. The drinking flask of claim 3, wherein the lid is circular and wherein the upper portion has two diametrically opposed projections and the base portion has two corresponding tracks.

8. The drinking flask of claim 1, wherein the wing portions have tapered longitudinal outer edges and inwardly directed sidewalls in the junction regions defining rest areas of finger tips.

9. The drinking flask of claim 8, wherein one of the wing portions in an area adjacent to an outer edge and adjacent to the upper end of the columnar portion defines a transverse bore therethrough for receipt of a human digit.

10. The drinking flask of claim 1, wherein one of the wing portions in an area outwardly disposed with respect to one of the junction regions and adjacent to the upper end of the columnar portion defines a transverse bore therethrough for receipt of a human digit.

11. A drinking flask, comprising:

a substantially hollow bottle having a central, elongated columnar portion having upper and lower ends, the lower end being adapted for removable receipt of a cap, the columnar portion being in fluid communication with diametrically opposed, elongated, laterally extending wing portions at junction regions there between; and, a drinking lid removably attached to the upper end of the columnar portion, wherein the lid defines a drinking basin sized to accept a user's lips and to removably accept a cap in a friction fit, such that the lower end with a cap thereon and bottoms of the wing portions are substantially aligned in a plane so that the flask can rest on a surface in a drinking configuration.

12. The drinking flask of claim 11, wherein the drinking lid has a base portion and an upper portion including actuating means for rotatably and axially moving the upper portion with respect to the base portion from a first locked position through a second drinking position and to a third removable position.

13. The drinking flask of claim 12, wherein the actuating means includes a guide track on an outer perimeter of the base portion and a radially inwardly directed projection on the upper portion for receipt in the guide track, wherein the guide track has an elongated circumferential first groove terminating in a short vertical second groove, the second groove terminating in a short, circumferential third groove, and the third groove terminating in a short vertical fourth groove having an open end.

14. The drinking flask of claim 13, including detents between the fist and second grooves and between the third and fourth grooves.

15. The drinking flask of claim 13, wherein the first circumferential groove subtends an angle of approximately forty degrees and wherein the third circumferential groove subtends an angle of approximately ten degrees.

16. The drinking flask of claim 13, including a detent in the first groove adjacent to an end of the first groove away from the second groove corresponding to a closed and locked position of the lid.

17. The drinking flask of claim 13, wherein the lid is circular and wherein the upper portion has two diametrically opposed projections and the base portion has two corresponding tracks.

18. The drinking flask of claim 11, wherein the wing portions have tapered longitudinal outer edges and inwardly directed sidewalls in the junction regions defining rest areas of finger tips.

19. The drinking flask of claim 18, wherein one of the wing portions in an area adjacent to an outer edge and adjacent to the upper end of the columnar portion defines a transverse bore therethrough for receipt of a human digit.

20. The drinking flask of claim 11, including a cap for selective receipt on the lid and on the lower end of the columnar portion.

* * * * *